US011725651B2

(12) United States Patent
Myers et al.

(10) Patent No.: US 11,725,651 B2
(45) Date of Patent: Aug. 15, 2023

(54) PLUNGER BORE SLEEVE FOR A RECIPROCATING PUMP

(71) Applicant: SPM Oil & Gas Inc., Fort Worth, TX (US)

(72) Inventors: Jeff Myers, Fort Worth, TX (US); Justin Rand Cummings, Fort Worth, TX (US); Tanner Craig Ford, Fort Worth, TX (US)

(73) Assignee: SPM Oil & Gas Inc., Fort Worth, TX (US)

( * ) Notice: Subject to any disclaimer, the term of this patent is extended or adjusted under 35 U.S.C. 154(b) by 200 days.

(21) Appl. No.: 17/043,541

(22) PCT Filed: Apr. 2, 2019

(86) PCT No.: PCT/US2019/025371

§ 371 (c)(1),
(2) Date: Sep. 29, 2020

(87) PCT Pub. No.: WO2019/195279

PCT Pub. Date: Oct. 10, 2019

(65) Prior Publication Data

US 2021/0017983 A1 Jan. 21, 2021

Related U.S. Application Data

(60) Provisional application No. 62/651,661, filed on Apr. 2, 2018, provisional application No. 62/687,064, filed on Jun. 19, 2018.

(51) Int. Cl.

| | |
|---|---|
| ***F04B 53/16*** | (2006.01) |
| ***F04B 1/053*** | (2020.01) |
| ***F04B 19/22*** | (2006.01) |

(52) U.S. Cl.
CPC ..... *F04B 53/168* (2013.01); *F04B 1/053* (2013.01); *F04B 19/22* (2013.01)

(58) Field of Classification Search
CPC ..... F04B 53/16; F04B 53/168; F04B 39/041; F16J 15/166; F16J 15/18
See application file for complete search history.

(56) References Cited

U.S. PATENT DOCUMENTS 3,417,702 A * 12/1968 Behm ..... F04B 1/02 92/130 C
3,785,659 A * 1/1974 Maurer ..... F16J 15/186 277/516

(Continued)

FOREIGN PATENT DOCUMENTS

DE 102009034930 A1 * 2/2011 ..... F04B 1/2035
GB 0 687 108 A 2/1953

(Continued)

OTHER PUBLICATIONS

International Search Report and Written Opinion of International Patent Application No. PCT/US2019/025371 dated Jun. 12, 2019, 3 pages.

*Primary Examiner* — Philip E Stimpert

(57) ABSTRACT

A fluid cylinder for a fluid end section of a reciprocating pump includes a body having a pressure chamber and a plunger bore that fluidly communicates with the pressure chamber. The plunger bore includes a packing segment configured to hold packing. The fluid cylinder includes a sleeve received within the packing segment of the plunger bore. The sleeve is configured to hold a plunger within an internal passage of the sleeve such that the plunger is configured to reciprocate within the plunger bore during operation of the reciprocating pump. The fluid cylinder includes a retention mechanism secured within the plunger bore such that the retention mechanism is configured to (Continued)

retain the sleeve within the packing segment of the plunger bore.

20 Claims, 7 Drawing Sheets

(56) References Cited

U.S. PATENT DOCUMENTS

| | | | | |
|---|---|---|---|---|
| 3,786,729 | A | 1/1974 | Rizzone | |
| 4,123,836 | A | 11/1978 | Buckell | |
| 2005/0200081 | A1 * | 9/2005 | Stanton | F16J 15/183 277/510 |

FOREIGN PATENT DOCUMENTS

| | | | | |
|---|---|---|---|---|
| GB | 687108 | * | 2/1953 | |
| WO | WO-01/09535 | A1 | 2/2001 | |
| WO | WO-0109535 | A1 * | 2/2001 | F16J 15/185 |
| WO | WO-2006069819 | A1 * | 7/2006 | F04B 1/0404 |
| WO | WO-2016012076 | A1 * | 1/2016 | F02M 59/102 |

* cited by examiner

PLUNGER BORE SLEEVE FOR A RECIPROCATING PUMP

CROSS-REFERNCE TO RELATED APPLICATIONS

This application is filed under 35 U.S.C. 371, filed from PCT/US2019/025371, having a filing date of Apr. 2, 2019 and entitled "PLUNGER BORE SLEEVE FOR A RECIPROCATING PUMP," which claims the benefit of and priority to U.S. Provisional Patent Application Ser. No. 62/651,661, filed on Apr. 2, 2018 and entitled "PACKING BORE SLEEVE," and U.S. Provisional Patent Application Ser. No. 62/687,064, filed on Jun. 19, 2018 and entitled "PACKING BORE SLEEVE," all of which are incorporated herein by reference in their entirety for all purposes.

TECHNICAL FIELD

This disclosure relates to reciprocating pumps, and, in particular, to plunger throws used in reciprocating pumps.

BACKGROUND OF THE DISCLOSURE

In oilfield operations, reciprocating pumps are used for different applications such as fracturing subterranean formations to drill for oil or natural gas, cementing the wellbore, or treating the wellbore and/or formation. A reciprocating pump designed for fracturing operations is sometimes referred to as a "frac pump." A reciprocating pump typically includes a power end section and a fluid end section. The fluid end section can be formed of a one piece construction or a series of blocks secured together by rods. The fluid end section includes a fluid cylinder (sometimes referred to as a cylinder section or a fluid end block) having a plunger bore for receiving a plunger or plunger throw, an inlet fluid passage, and an outlet fluid passage (sometimes referred to as a discharge passage). During operation of a reciprocating pump, a fluid is pumped into the fluid cylinder through the inlet passage and out of the pump through the outlet passage. The inlet and outlet passages each include a valve assembly to control the flow of fluid into and out of the fluid cylinder. For example, the valve assemblies can be differential pressure valves that are opened by differential pressure of fluid and allow the fluid to flow in only one direction through the corresponding inlet or outlet passage.

Some reciprocating pumps include packing within the plunger bore to facilitate sealing the plunger within the plunger bore. But, when the packing and/or another seal of the fluid end section fails, the plunger bore gets cut by the relatively high-pressure fluids moving through the reciprocating pump such the plunger bore can no longer adequately seal with the plunger (commonly referred to "washout"). Moreover, over time the relatively high cyclical rates and/or loads of the reciprocating pump causes the packing to wear into the plunger bore and thereby form undulations (i.e., waves) in the inner wall of the plunger bore, which is commonly referred to as "washboarding". Eventually, the plunger bore becomes sufficiently washboarded that the packing will no longer seal with the inner wall of the plunger bore. Washouts and washboarding can be weld repaired, but such welding operations are relatively costly and may reduce the strength of the fluid cylinder. Moreover, while washed-out and/or washboarded plunger bores can be sleeved to return the fluid cylinder to service, the relatively high cyclical rates and/or loads of the reciprocating pump make it difficult to retain the sleeve within the plunger bore.

SUMMARY

This summary is provided to introduce a selection of concepts in a simplified form that are further described below in the Detailed Description. This summary is not intended to identify key features or essential features of the claimed subject matter. Nor is it intended to be used as an aid in determining the scope of the claimed subject matter.

In a first aspect, a fluid cylinder for a fluid end section of a reciprocating pump includes a body having a pressure chamber and a plunger bore that fluidly communicates with the pressure chamber. The plunger bore includes a packing segment configured to hold packing. The fluid cylinder includes a sleeve received within the packing segment of the plunger bore. The sleeve is configured to hold a plunger within an internal passage of the sleeve such that the plunger is configured to reciprocate within the plunger bore during operation of the reciprocating pump. The fluid cylinder includes a retention mechanism secured within the plunger bore such that the retention mechanism is configured to retain the sleeve within the packing segment of the plunger bore.

In some embodiments, the retention mechanism includes a snap ring.

In some embodiments, the retention mechanism abuts an end portion of the sleeve.

In some embodiments, the sleeve is fixedly secured within the packing segment of the plunger bore at least in part by the retaining mechanism.

In some embodiments, the fluid cylinder further includes a seal operatively connected between the sleeve and the packing segment of the plunger bore.

In some embodiments, the retention mechanism includes a ring having an inner diameter that is smaller than an inner diameter of the sleeve.

In some embodiments, the plunger bore includes a groove extending into an inner wall of the plunger bore. The retention mechanism extends within the groove.

In some embodiments, the plunger bore includes a recess extending into an inner wall of the plunger bore. The retention mechanism extends within the recess.

In some embodiments, the plunger bore includes a recess extending into an inner wall of the plunger bore. The recess includes a thread. The retention mechanism includes a threaded insert that is threadedly received within the recess.

In some embodiments, the retention mechanism is secured within the plunger bore using at least one of an interference-fit, a press-fit, a snap-fit, a weld, an epoxy, an adhesive, a fastener, or a threaded fastener.

In a second aspect, a reciprocating pump includes a power end section and a fluid end section operatively connected to the power end section. The fluid end section has a fluid cylinder that includes a body having a pressure chamber and a plunger bore that fluidly communicates with the pressure chamber. The plunger bore includes a packing segment configured to hold packing. The fluid cylinder includes a sleeve received within the packing segment of the plunger bore. The sleeve is configured to hold a plunger within an internal passage of the sleeve such that the plunger is configured to reciprocate within the plunger bore during operation of the reciprocating pump. The fluid cylinder includes a retention mechanism secured within the plunger bore such that the retention mechanism is configured to retain the sleeve within the packing segment of the plunger bore.

In some embodiments, the retention mechanism includes a snap ring.

In some embodiments, the retention mechanism abuts an end portion of the sleeve.

In some embodiments, the sleeve is fixedly secured within the packing segment of the plunger bore at least in part by the retaining mechanism.

In some embodiments, the fluid cylinder further includes a seal operatively connected between the sleeve and the packing segment of the plunger bore.

In some embodiments, the plunger bore includes a groove extending into an inner wall of the plunger bore. The retention mechanism extends within the groove.

In some embodiments, the plunger bore includes a recess extending into an inner wall of the plunger bore. The retention mechanism extends within the recess.

In some embodiments, the retention mechanism is secured within the plunger bore using at least one of an interference-fit, a press-fit, a snap-fit, a weld, an epoxy, an adhesive, a fastener, or a threaded fastener.

In a third aspect, a method for installing a sleeve within a plunger bore of a fluid end section of a reciprocating pump includes cooling the sleeve such that the sleeve shrinks radially inward; inserting the shrunken sleeve into a packing segment of the plunger bore; heating the shrunken sleeve with the sleeve received within the packing segment such that the sleeve expands radially outward and forms an interference fit with the packing segment; and installing a retention mechanism within the plunger bore such that the retention mechanism abuts the sleeve.

In some embodiments, heating the shrunken sleeve includes exposing the sleeve to ambient temperature such that the sleeve returns to ambient temperature.

Other aspects, features, and advantages will become apparent from the following detailed description when taken in conjunction with the accompanying drawings, which are a part of this disclosure and which illustrate, by way of example, principles of the inventions disclosed.

BRIEF DESCRIPTION OF THE DRAWINGS

The accompanying drawings facilitate an understanding of the various embodiments.

Corresponding reference characters indicate corresponding parts throughout the drawings.

DETAILED DESCRIPTION

Certain embodiments of the disclosure provide a fluid cylinder for a fluid end section of a reciprocating pump includes a body having a pressure chamber and a plunger bore that fluidly communicates with the pressure chamber. The plunger bore includes a packing segment configured to hold packing. The fluid cylinder includes a sleeve received within the packing segment of the plunger bore. The sleeve is configured to hold a plunger within an internal passage of the sleeve such that the plunger is configured to reciprocate within the plunger bore during operation of the reciprocating pump. The fluid cylinder includes a retention mechanism secured within the plunger bore such that the retention mechanism is configured to retain the sleeve within the packing segment of the plunger bore.

Certain embodiments of the disclosure provide a method for installing a sleeve within a plunger bore of a fluid end section of a reciprocating pump includes cooling the sleeve such that the sleeve shrinks radially inward; inserting the shrunken sleeve into a packing segment of the plunger bore; heating the shrunken sleeve with the sleeve received within the packing segment such that the sleeve expands radially outward and forms an interference fit with the packing segment; and installing a retention mechanism within the plunger bore such that the retention mechanism abuts the sleeve.

Certain embodiments of the disclosure provide relatively inexpensive and reliable solutions for remedying washboarding and/or washout of a packing segment of a plunger bore of a reciprocating pump. Certain embodiments of the disclosure increase the longevity of a fluid cylinder of the reciprocating pump and thereby reduce operating costs of the reciprocating pump. Certain embodiments of the disclosure provide improved retention of a sleeve within a plunger bore of a reciprocating pump. Certain embodiments of the disclosure increase the longevity of the sleeve and/or reduce operating costs of the reciprocating pump. Certain embodiments of the disclosure increase the longevity of a seal between a sleeve and a plunger bore of a reciprocating pump and thereby reduce the operating costs of the reciprocating pump.

Figure 1:
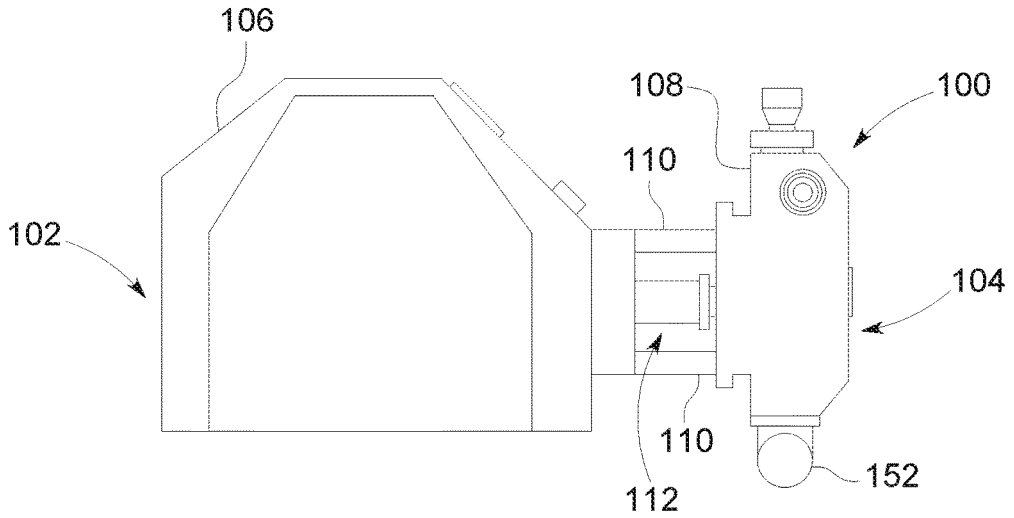
FIG. 1 is an elevational view of a reciprocating pump assembly according to an exemplary embodiment.

Referring to FIG. 1, an illustrative embodiment of a reciprocating pump assembly 100 is presented. The reciprocating pump assembly 100 includes a power end section 102 and a fluid end section 104 operably coupled thereto. The power end section 102 includes a housing 106 in which a crankshaft (not shown) is disposed. Rotation of the crankshaft is driven by an engine or motor (not shown) of the power end section 102. The fluid end section 104 includes a fluid cylinder 108 (sometimes referred to as a "fluid end block" or a "cylinder section"), which in the exemplary embodiments is connected to the housing 106 via a plurality of stay rods 110. Other structures may be used to connect the fluid end section 104 to the housing 106 in addition or alternatively to the stay rods 110. In operation, the crankshaft reciprocates a plunger rod assembly 112 between the power end section 102 and the fluid end section 104 to thereby pump (i.e., move) fluid through the fluid cylinder 108.

According to some embodiments, the reciprocating pump assembly 100 is freestanding on the ground, mounted to a trailer for towing between operational sites, mounted to a skid, loaded on a manifold, otherwise transported, and/or the like. The reciprocating pump assembly 100 is not limited to frac pumps or the plunger rod pump shown herein. Rather, the embodiments disclosed herein may be used with any other type of pump that includes a plunger rod assembly.

Figure 2:
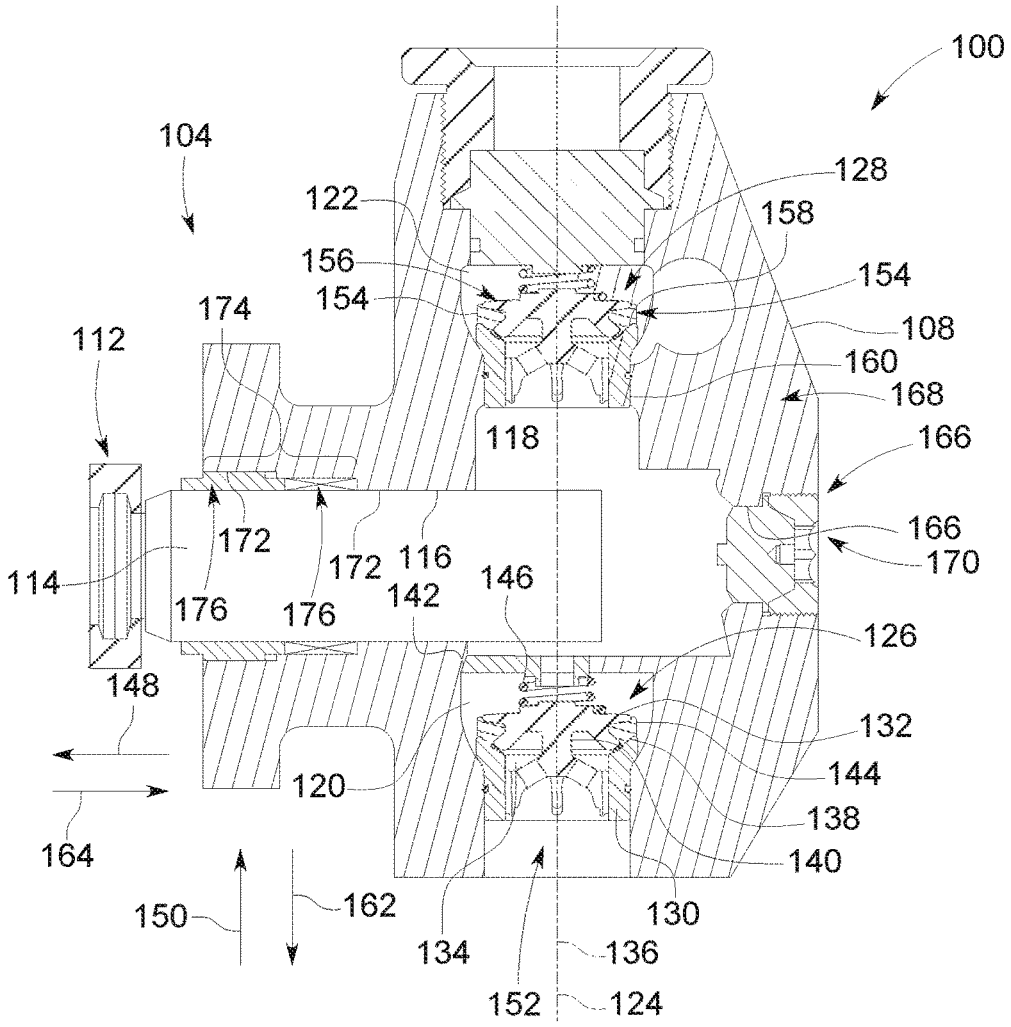
FIG. 2 is a cross-sectional view of a fluid end section of the reciprocating pump assembly shown in FIG. 1 according an exemplary embodiment.

Referring now to FIG. 2, the plunger rod assembly 112 includes a plunger 114 extending through a plunger bore 116 and into a pressure chamber 118 formed in the fluid cylinder 108. At least the plunger bore 116, the pressure chamber 118, and the plunger 114 together may be characterized as a "plunger throw." According to some embodiments, the reciprocating pump assembly 100 includes three plunger throws (i.e., a triplex pump assembly); however, in other embodiments, the reciprocating pump assembly 100 includes a greater or fewer number of plunger throws.

As shown in FIG. 2, the fluid cylinder 108 includes inlet and outlet fluid passages 120 and 122, respectively, formed therein. Optionally, the inlet and outlet fluid passages 120 and 122, respectively, are coaxially disposed along a fluid passage axis 124, for example as is shown in FIG. 2. Fluid is adapted to flow through the inlet and outlet fluid passages 120 and 122, respectively, and along the fluid passage axis 124. An inlet valve assembly 126 is disposed in the inlet fluid passage 120 and an outlet valve assembly 128 is disposed in the outlet fluid passage 122. In the exemplary embodiments, the valve assemblies 126 and 128 are spring-loaded, which, as described in greater detail below, are actuated by at least a predetermined differential pressure across each of the valve assemblies 126 and 128.

The inlet valve assembly 126 includes a valve seat 130 and a valve member 132 that is configured to be sealingly engaged therewith. The valve seat 130 includes an inlet valve bore 134 that extends along a valve seat axis 136 that is coaxial with the fluid passage axis 124 when the inlet valve assembly 126 is disposed in the inlet fluid passage 120. The valve seat 130 further includes a shoulder 138, which in the exemplary embodiment is tapered (i.e., extends at an oblique angle relative to the valve seat axis 136). In some other examples, the shoulder 138 of the valve seat 130 extends approximately perpendicular to the valve seat axis 136.

The valve member 132 includes a valve head 142 and a tail segment 140 extending from the valve head 142. As shown in FIG. 2, the tail segment 140 is received within the inlet valve bore 134 of the valve seat 130 when the inlet valve assembly 126 is assembled as shown. The valve head 142 includes a seal 144. The valve head 142 of the valve member 132 is moveable relative to the valve seat 130 along the valve seat axis 136 between an open position and a closed position. In the closed position of the valve member 132, the seal 144 of the valve head 142 sealingly engages the valve seat 130 to prevent fluid flow through the inlet valve assembly 126. In the exemplary embodiments, the valve member 132 is engaged and otherwise biased by a spring 146, which, as discussed in greater detail below, biases the valve member 132 to the closed position.

In the embodiments illustrated herein, the outlet valve assembly 128 is substantially similar to the inlet valve assembly 126 and therefore will not be described in further detail herein.

In operation, the plunger 114 reciprocates within the plunger bore 116 for movement into and out of the pressure chamber 118. That is, the plunger 114 moves back and forth horizontally, as viewed in FIG. 2, away from and towards the fluid passage axis 124 in response to rotation of the crankshaft (not shown) that is enclosed within the housing 106 (FIG. 1) of the power end section 102 (FIG. 1). Movement of the plunger 114 in the direction of arrow 148 away from the fluid passage axis 124 and out of the pressure chamber 118 will be referred to herein as the suction stroke of the plunger 114. As the plunger 114 moves along the suction stroke, the inlet valve assembly 126 is opened to the open position of the valve member 132. More particularly, as the plunger 114 moves away from the fluid passage axis 124 in the direction of arrow 148, the pressure inside the pressure chamber 118 decreases, creating a differential pressure across the inlet valve assembly 126 and causing the valve head 142 of the valve member 132 to move (relative to the valve seat 130) upward, as viewed in FIG. 2, along the valve seat axis 136 in the direction of arrow 150. As a result of the upward movement of the valve head 142 of the valve member 132 along the valve seat axis 136, the spring 146 is compressed and the valve head 142 of the valve member 132 separates from the shoulder 138 of the valve seat 130 to move the valve member 132 to the open position. In the open position of the valve member 132, fluid entering through an inlet 152 of the inlet fluid passage 120 flows along the fluid passage axis 124 and through the inlet valve assembly 126, being drawn into the pressure chamber 118. To flow through the inlet valve assembly 126, the fluid flows through the inlet valve bore 134 and along the valve seat axis 136.

During the fluid flow through the inlet valve assembly 126 and into the pressure chamber 118, the outlet valve assembly 128 is in a closed position wherein a seal 154 of a valve member 156 of the outlet valve assembly 128 is sealingly engaged with a shoulder 158 of a valve seat 160 of the outlet valve assembly 128. Fluid continues to be drawn into the pressure chamber 118 until the plunger 114 is at the end of the suction stroke of the plunger 114, wherein the plunger 114 is at the farthest point from the fluid passage axis 124 of the range of motion of the plunger 114.

At the end of the suction stroke of the plunger 114, the differential pressure across the inlet valve assembly 126 is such that the spring 146 of the inlet valve assembly 126 begins to decompress and extend, forcing the valve head 142 of the valve member 132 of the inlet valve assembly 126 to move (relative to the valve seat 130) downward, as viewed in FIG. 2, along the valve seat axis 136 in the direction of arrow 162. As a result, the inlet valve assembly 126 moves to the closed position of the valve member 132 wherein the valve head 142 of the valve member 132 is sealingly engaged with the valve seat 130.

Movement of the plunger 114 in the direction of arrow 164 toward the fluid passage axis 124 and into the pressure chamber 118 will be referred to herein as the discharge stroke of the plunger 114. As the plunger 114 moves along the discharge stroke into the pressure chamber 118, the pressure within the pressure chamber 118 increases. The pressure within the pressure chamber 118 increases until the differential pressure across the outlet valve assembly 128 exceeds a predetermined set point, at which point the outlet valve assembly 128 opens and permits fluid to flow out of the pressure chamber 118 along the fluid passage axis 124, being discharged through the outlet valve assembly 128. During the discharge stroke of the plunger 114, the valve member 132 of the inlet valve assembly 126 is positioned in the closed position wherein the valve head 142 of the valve member 132 is sealingly engaged with the valve seat 130.

The fluid cylinder 108 of the fluid end section 104 of the reciprocating pump assembly 100 includes an access port 166. The access port 166 is defined by an opening that extends through a body 168 of the fluid cylinder 108 to provide access to the pressure chamber 118 and thereby internal components of the fluid cylinder 108 (e.g., the inlet valve assembly 126, the outlet valve assembly 128, the plunger 114, etc.) for service (e.g., maintenance, replacement, etc.) thereof. The access port 166 of the fluid cylinder 108 is closed using a suction cover assembly 170 to seal the pressure chamber 118 of the fluid cylinder 108 at the access port 166.

The plunger bore 116 is defined by an inner wall 172 of the body 168 of the fluid cylinder 108. In other words, the plunger bore 116 includes the inner wall 172. As shown in FIG. 2, the plunger bore 116 includes a packing segment 174. The plunger rod assembly 112 includes packing 176 that is received within the packing segment 174 of the plunger bore 116 such that the packing 176 extends radially between the plunger 114 and the inner wall 172 to facilitate sealing the plunger 114 within the plunger bore 116 of the fluid cylinder 108.

Figure 3:
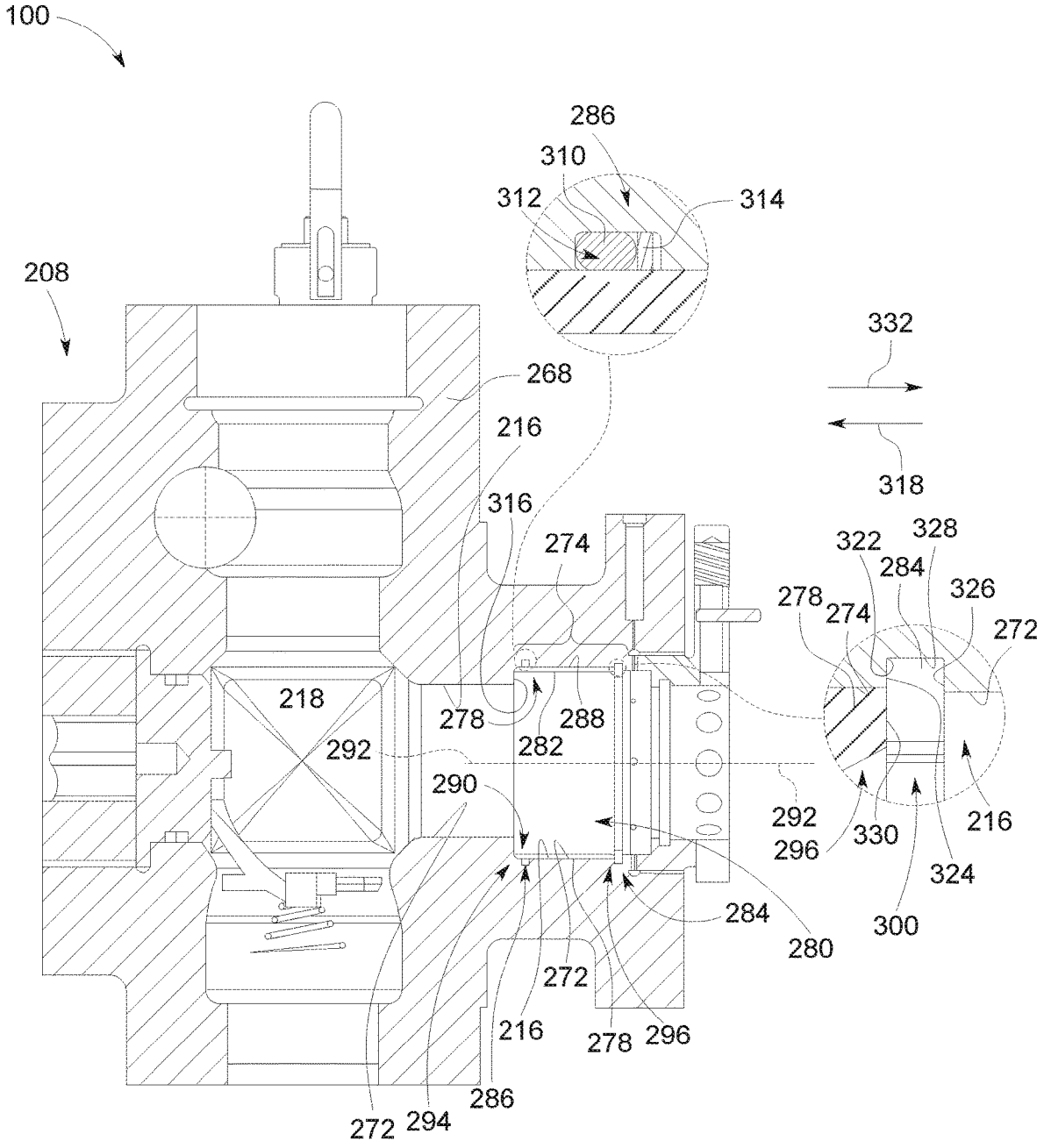
FIG. 3 is a cross-sectional view of a fluid cylinder of the reciprocating pump assembly shown in FIG. 1 according to another exemplary embodiment.

Referring now to FIG. 3, a fluid cylinder 208 of the reciprocating pump assembly 100 according to another exemplary embodiment is shown. A plunger rod assembly (not shown; e.g., the plunger rod assembly 112 shown in FIGS. 1 and 2, etc.) and at least portions of the valve assemblies (not shown; e.g., the valve assembly 126 and/or 128 shown in FIG. 2, etc.) have been removed from the fluid cylinder 208 shown in FIG. 3 for clarity. The fluid cylinder 208 includes a body 268 having a pressure chamber 218 and a plunger bore 216 that fluidly communicates with the pressure chamber 218. The plunger bore 216 includes an inner wall 272. As can be seen in FIG. 3, the plunger bore 216 includes a packing segment 274 that is configured to hold packing (not shown; e.g., the packing 176 shown in FIG. 2, etc.), for examples as is described below. To remedy washboarding and/or washout of the inner wall 272 of the plunger bore 216, the fluid cylinder 208 includes a sleeve 278 received within the packing segment 274 of the plunger bore 216. Optionally, the inner wall 272 of the plunger bore 216 is machined along at least a portion of the packing segment 274 to define a radial pocket (not shown) within the packing segment 274 that receives the sleeve 278 therein.

The sleeve 278 includes an internal passage 280. The sleeve 278 holds a plunger (not shown; e.g., the plunger 114 shown in FIG. 2, etc.) within the internal passage 280 such that the plunger reciprocates within the internal passage 280, and thus within the plunger bore 216, during operation of the reciprocating pump assembly 100. As briefly described above, the packing segment 274 of the plunger bore 216 holds packing therein. Specifically, the sleeve 278 includes an inner wall 282 that defines the internal passage 280 and the packing is received within the internal passage 280 of the sleeve 278 such that the packing 176 extends radially between an exterior surface (not shown) of the plunger and the inner wall 282 of the sleeve 278. In other words, the sleeve 278 holds the packing within the internal passage 280 of the sleeve 278 and the packing holds the plunger within the internal passage 280. The packing thereby seals the radial gap defined between the plunger and the inner wall 282 of the sleeve 278 to facilitate sealing the plunger within the plunger bore 216 of the fluid cylinder 208.

The fluid cylinder 208 includes a retention mechanism 284 that is secured within the plunger bore 216. As will be described in more detail below, the retention mechanism 284 retains the sleeve 278 within the packing segment 274 of the plunger bore 216 (e.g., prevents the sleeve 278 from backing out of the plunger bore 216, etc.). In some embodiments, the fluid cylinder 208 includes a seal 286 operatively connected between an outer wall 288 of the sleeve 278 and the inner wall 272 of the packing segment 274 to facilitate sealing the sleeve 278 to the plunger bore 216. The seal 286 will be described in more detail below with reference to FIGS. 3, 8, and 9.

Figure 4:
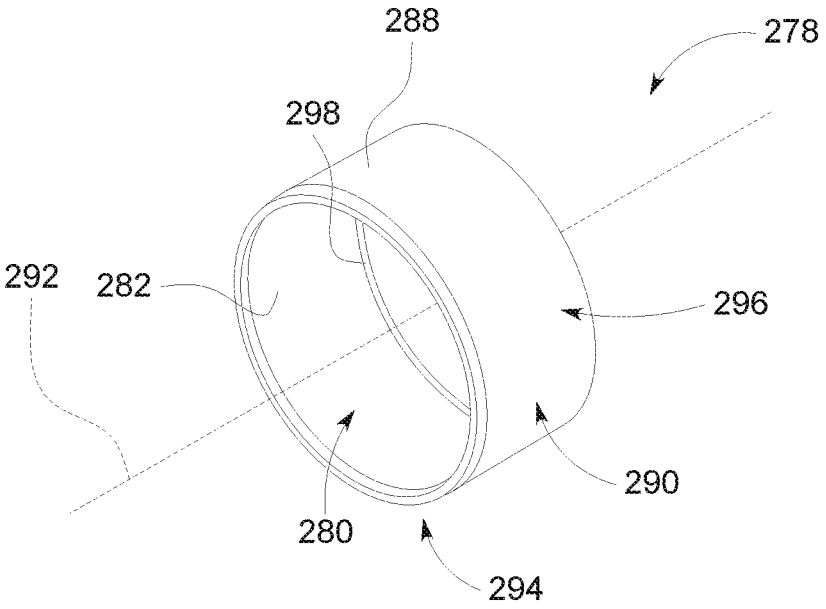
FIG. 4 is a perspective view of a sleeve of the fluid cylinder shown in FIG. 3 according to an exemplary embodiment.
Figure 5:
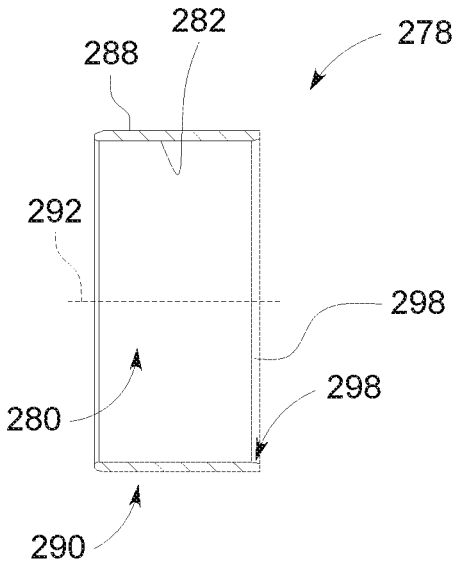
FIG. 5 is a cross-sectional view of the sleeve shown in FIG. 4.

Referring now to FIGS. 4 and 5, the sleeve 278 includes a body 290 that extends a length along central longitudinal axis 292 from an end portion 294 to an opposite end portion 296. The body 290 of the sleeve 278 includes the inner and outer walls 282 and 288, respectively. As can be seen in FIGS. 4 and 5, the internal passage 280 of the sleeve 278 extends through the length of the sleeve 278. In the exemplary embodiment, the inner wall 282 of the body 290 includes a tapered end segment 298 at the end portion 294 of the body 290. Specifically, the end segment 298 of the inner wall 282 tapers inward toward the central longitudinal axis 292. The tapered end segment 298 may have any angle of taper relative to the central longitudinal axis 292. In some other embodiments, the end segment 298 of the inner wall 282 is not tapered relative to the central longitudinal axis 292.

In some embodiments, the body 290 of the sleeve 278 is provided with anti-wear properties (e.g., strength, toughness, hardness, material consistency, etc.) to resist wear caused by washouts and/or washboarding. For example, in some embodiments the body 290 of the sleeve 278 has a material hardness value that is selected to reduce wear caused by washouts and/or washboarding. In some examples, the material hardness value of the body 290 of the sleeve 278 is greater than approximately 8 GPa, greater than approximately 12 GPa, between approximately 10 to approximately 22 GPa, and/or the like with reference to the Vickers hardness number. In some embodiments, the material(s) of the body 290 is selected to provide the sleeve 278 with anti-wear properties. Examples of materials that can be selected to provide the sleeve 278 with anti-wear properties include, but are not limited to, a steel (e.g., stainless steel, a hardened steel, etc.) a ceramic, tungsten cobalt, tungsten nickel, a tungsten carbide, tungsten carbide cobalt (e.g., tungsten carbide combined with approximately 6-10% cobalt, etc.), tungsten carbide nickel, zirconia, partially stabilized zirconia, titanium carbide, silicon nitride, sialon, a self-healing ceramic, a self-healing metal, a refractory material (e.g., oxides of aluminum, silicon, magnesium, etc.), and/or the like. In addition or alternatively, any other materials are used in other embodiments. The anti-wear properties increase the longevity of the sleeve 278 and thereby reduce operating costs of the reciprocating pump assembly 100.

Figure 6:
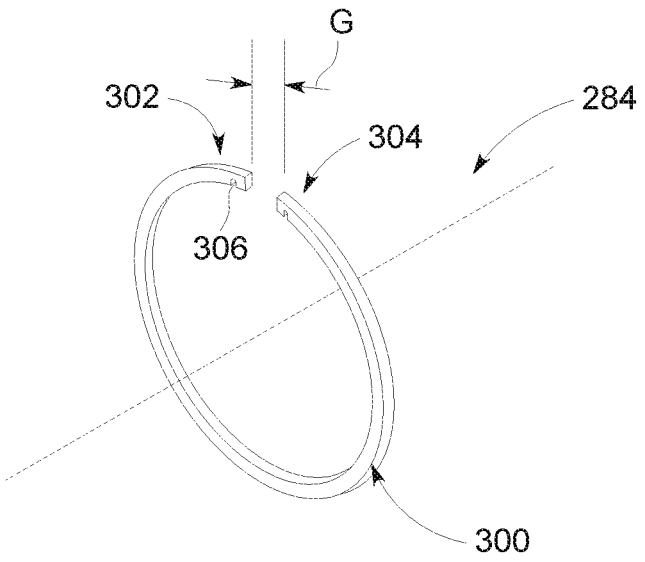
FIG. 6 is a perspective view of a retention mechanism of the fluid cylinder shown in FIG. 3 according to an exemplary embodiment.
Figure 7:
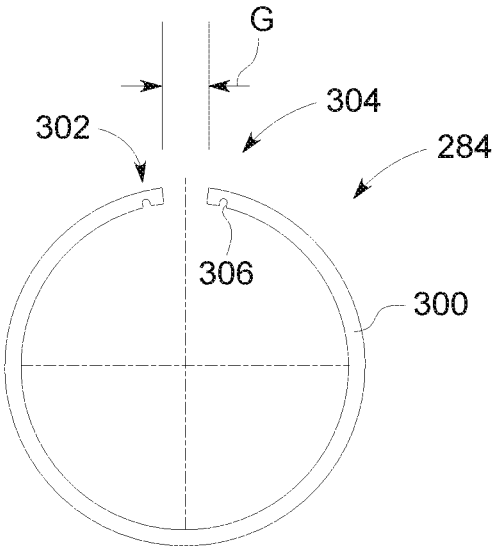
FIG. 7 is an elevational view of the retention mechanism shown in FIG. 6.

Referring now to FIGS. 6 and 7, the exemplary embodiment of the retention mechanism 284 is a snap-ring. Specifically, the retention mechanism 284 includes a body 300 having a ring shape that is open (i.e., non-continuous) as opposed to being closed (i.e., continuous). In other words, the body 300 of the retention mechanism 284 extends a length along an annular path from an end portion 302 to an end portion 304 that opposes (i.e., faces), and is spaced apart by a gap G from, the end portion 302. In some other embodiments, the body 300 of the retention mechanism 284 has a ring shaped that is closed. The retention mechanism 284 is not limited to a snap-ring or any other type of ring. Rather, the retention mechanism 284 additionally or alternatively can include any other structure that enables the retention mechanism 284 to function as described and/or illustrated herein (e.g., to retain the sleeve 278 shown in FIGS. 3-5 within the packing segment 274 shown in FIG. 3 during operation of the reciprocating pump assembly 100 shown in FIG. 1, etc.), examples of which are described below.

In the exemplary embodiment of the retention mechanism 284, the body 300 is resilient. The gap G enables the body 300 to partially collapse radially inward relative to a central longitudinal axis 306 of the body 300 by forcing the end portions 302 and 304 toward each other (i.e., reducing the gap G) against the bias of the body 300 to the natural resting size and shape shown in FIGS. 6 and 7 (e.g., using a tool, and individual's hand(s), etc.). The size (e.g., diameter, etc.) of the body 300 thus can be reduced to enable installation of the retention mechanism 284 into the plunger bore 216 and removal of the retention mechanism 284 from the plunger bore 216. The end portions 302 and 304 include optional tool openings 308 (e.g., Type A ends, etc.) that enable a snap-ring tool (not shown) to grasp and squeeze the end portions 302 and 304 toward each other to thereby reduce the size of the body 300. In some other embodiments, other structures (e.g., extensions, protrusions, arms, etc.) are used in addition or alternative to the tool openings 308 to enable a tool and/or an individual to squeeze the end portions 302 and 304 toward each other and thereby reduce the size of the body 300.

Various parameters of the retention mechanism 284 are selected to enable the retention mechanism 284 to retain the sleeve 278 within the packing segment 274 of the plunger bore 216 during operation of the reciprocating pump assembly 100. For example, in some embodiments, one or more various parameters of the retention mechanism 284 is selected to prevent the body 300 of the retention mechanism 284 from bending, breaking, tearing, fracturing, collapsing, and/or otherwise failing under the relatively high cyclical rates, relatively high pressures, relatively high loads, and/or relatively low operational temperatures of the reciprocating pump assembly 100 (e.g., pressures of at least approximately 5,000 pounds per square inch (psi), pressures of at least approximately 10,000 psi, pressures between approximately 8,000 psi and approximately 26,000 psi, pressures greater than approximately 15,000 psi, rates of up to approximately 1,000 strokes per minute, rates of greater than approximately 1,000 strokes per minute, temperatures below approximately 0° C., temperatures below approximately −20° C., temperatures between approximately 0° C. and approximately −40° C., temperatures below approximately −40° C., etc.). In one specific example, one or more parameters of the retention mechanism 284 is selected to enable the retention mechanism 284 to retain the sleeve 278 within the packing segment 274 of the plunger bore 216 at operational pressures up to at least approximately 15,000 psi and at operational temperatures down to approximately −40° C. or lower. Operation of the retention mechanism 284 to retain the sleeve 278 within the packing segment 274 of the plunger bore 216 will be described in more detail below with reference to FIG. 3.

Examples of parameters of the retention mechanism 284 selected to enable the retention mechanism 284 to retain the sleeve 278 within the packing segment 274 during operation of the reciprocating pump assembly 100 include, but are not limited to, strength, toughness, hardness, material consistency, the particular type and/or combination of material(s) of the body 300, and/or the like. Examples of materials of the body 300 of the retention mechanism 284 that can be selected to enable the retention mechanism 284 to retain the sleeve 278 within the packing segment 274 include, but are not limited to, a steel (e.g., stainless steel, etc.), a ceramic, tungsten cobalt, tungsten nickel, a tungsten carbide, tungsten carbide cobalt (e.g., tungsten carbide combined with approximately 6-10% cobalt, etc.), tungsten carbide nickel, zirconia, partially stabilized zirconia, titanium carbide, silicon nitride, sialon, a self-healing ceramic, a self-healing metal, a refractory material (e.g., oxides of aluminum, silicon, magnesium, etc.), and/or the like. Any other materials additionally or alternatively are used in other embodiments.

Figure 8:
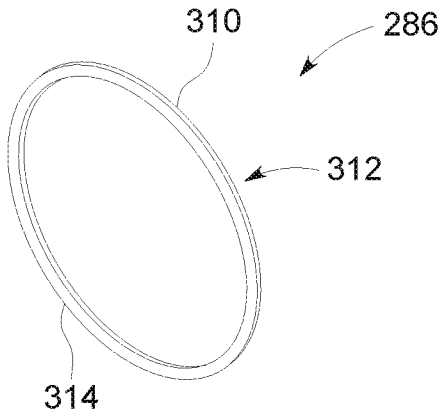
FIG. 8 is a perspective view of a seal of the fluid cylinder shown in FIG. 3 according to an exemplary embodiment.
Figure 9:
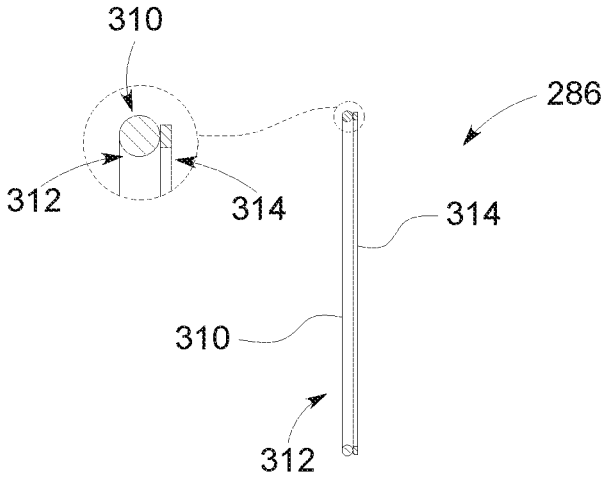
FIG. 9 is a cross-sectional view of the seal shown in FIG. 8.

Referring now to FIGS. 8 and 9, the exemplary embodiment of the fluid cylinder 208 (FIG. 3) includes the seal 286 for sealing the sleeve 278 (FIGS. 3-5) to the plunger bore 216 (FIG. 3). In some embodiments, the seal 286 is considered a "gland seal". The exemplary embodiment of the seal 286 includes an o-ring 310. The o-ring 310 includes a body 312 having a ring shape that is closed. In some other embodiments, the body 312 of the o-ring 310 has a ring shaped that is open. In the exemplary embodiment, the seal 286 includes a backing 314 that supports the o-ring 310 during operation of the reciprocating pump assembly 100 (FIG. 1). In some other embodiments, the seal 286 does not include the backing 314. Moreover, in some other embodiments, the fluid cylinder 208 does not include the seal 286 (e.g., no seal is used to seal the sleeve 278 to the plunger bore 216, a different type of seal is used at the same or a different location as compared to the seal 286 to seal the sleeve 278 to the plunger bore 216, etc.). Examples of different types seal that is used in some embodiments in addition or alternative to the exemplary seal 286 include, but are not limited to, a c-ring type seal, a steel c-ring type seal, and/or the like. Operation of the seal 286 will be described below with reference to FIG. 3.

Various parameters of the seal 286 are selected to enable the seal 286 to form a seal between the sleeve 278 and the plunger bore 216 and maintain the seal during operation of the reciprocating pump assembly 100. For example, in some embodiments, one or more various parameters of the seal 286 is selected to prevent the o-ring 310 from bending, breaking, tearing, collapsing, and/or otherwise failing under the relatively high cyclical rates, relatively high pressures, relatively high loads, and/or relatively low operational temperatures of the reciprocating pump assembly 100 (e.g., pressures of at least approximately 5,000 pounds per square inch (psi), pressures of at least approximately 10,000 psi, pressures between approximately 8,000 psi and approximately 26,000 psi, pressures greater than approximately 15,000 psi, rates of up to approximately 1,000 strokes per minute, rates of greater than approximately 1,000 strokes per minute, temperatures below approximately 0° C., temperatures below approximately −20° C., temperatures between approximately 0° C. and approximately −40° C., temperatures below approximately −40° C. etc.). In one specific example, one or more parameters of the seal 286 is selected to enable the seal 286 to maintain a seal between the sleeve 278 and the plunger bore 216 at operational pressures up to at least approximately 15,000 psi and at operational temperatures down to approximately −40° C. or lower.

Examples of parameters of the various components of the seal 286 (e.g., the o-ring 310, the backing 314, etc.) selected to enable the seal to form and maintain a seal between the sleeve 278 and the plunger bore 216 during operation of the reciprocating pump assembly 100 include, but are not limited to, resilience, strength, toughness, hardness, material consistency, the particular type and/or combination of material(s) of the body 312 of the o-ring 310, the particular type and/or combination of material(s) of the backing 314, and/or the like. Examples of materials of the body 312 of the o-ring 310 include, but are not limited to, an elastomeric material, a deformable thermoplastic material, a urethane material, a fiber-reinforced material, carbon, glass, cotton, wire fibers, cloth, and/or the like. In some embodiments, the body 312 of the o-ring 310 includes a cloth (e.g., carbon, glass, wire, cotton fibers, etc.), which is disposed in a thermoplastic material. In some other embodiments, the body 312 of the o-ring 310 is composed of at least a fiber-reinforced material, which can prevent or at least reduce delamination. In some embodiments, the body 312 of the o-ring 310 has a hardness of 95 A durometer or greater, or a hardness of 69 D durometer or greater based on the Rockwall Hardness scale. But, the body 312 of the o-ring 310 has any other hardness level that enables the seal 286 to function as described and/or illustrated herein in other embodiments.

Examples of materials of the backing 314 include, but are not limited to, a steel (e.g., stainless steel, etc.), a composite material (e.g., fiberglass, carbon fiber, Kevlar®, etc.), a ceramic, tungsten cobalt, tungsten nickel, a tungsten carbide, tungsten carbide cobalt (e.g., tungsten carbide combined with approximately 6-10% cobalt, etc.), tungsten carbide nickel, zirconia, partially stabilized zirconia, titanium carbide, silicon nitride, sialon, a self-healing ceramic, a self-healing metal, a refractory material (e.g., oxides of aluminum, silicon, magnesium, etc.), and/or the like. Any other materials additionally or alternatively are used in other embodiments.

Referring again to FIG. 3, the sleeve 278 is shown as received within the packing segment 274 of the plunger bore 216 such that the outer wall 288 of the sleeve 278 is engaged in physical contact with the inner wall 272 of the plunger bore 216 along the packing segment 274. As can be seen in FIG. 3, the end portion 294 of the sleeve 278 abuts a ledge 316 of the plunger bore 216. The engagement between the end portion 294 and the ledge 316 prevents the sleeve 278 from moving within the plunger bore 216 in the direction of the arrow 318. The ledge 316 thus retains the sleeve 278 in position within the plunger bore 216 (e.g., prevents the sleeve 278 from entering the pressure chamber 218 of the fluid cylinder 208, etc.) during operation of the reciprocating pump assembly 100.

When installed within the packing segment 274 of the plunger bore 216 as shown in FIG. 3, in some embodiments the sleeve 278 has an interference-fit with the packing segment 274 to secure the sleeve 278 within the packing segment 274. Specifically, the outer wall 288 of the sleeve 278 is stictionally engaged with the inner wall 272 of the plunger bore 216 such that stiction between the outer wall 288 and the inner wall 272 forms the interference-fit between the sleeve 278 and the packing segment 274 of the plunger bore 216. In some embodiments, the outer wall 288 and/or the inner wall 272 includes one or more barbs, textured areas (e.g., raised surfaces, patterned surfaces, etc.), protrusions, and/or the like that facilitates providing the interference-fit between the sleeve 278 and the packing segment 274 of the plunger bore 216. In addition or alternatively to an interference-fit, the sleeve 278 can be secured within the packing segment 274 of the plunger bore 216 using one or more welds, an epoxy, an adhesive (e.g., ethanol-based adhesives, water-based adhesives, glues, cements, etc.) or other type of bonding agent, one or more threaded fasteners (e.g., bolts, screws, nuts, studs, etc.), one or more other types of fasteners (e.g., clips, clamps, dowels, pins, rods, latches, etc.), and/or the like.

The sleeve 278 is installed within the packing segment 274 of the plunger bore 216 using any suitable method, process, and/or the like (e.g., to provide an interference-fit between the sleeve 278 and the packing segment 274, etc.). In one example, the sleeve 278 is press-fit into the packing segment 274 of the plunger bore 216 such that the sleeve 278 forms an interference-fit with the packing segment 274 once fully received within the packing segment 274. In another example, the sleeve 278 is shrunken radially inward relative to the central longitudinal axis 292 of the sleeve 278 and thereafter inserted into the packing segment 274 of the plunger bore 216 such that the sleeve 278 forms an interference-fit with the packing segment 274 as the sleeve 278 expands radially outward relative to the central longitudinal axis 292. For example, in some embodiments the sleeve 278 is: (1) cooled (e.g., using any cooling device, any method of removing temperature, etc.) to reduce (i.e., shrink) the diameter of the sleeve 278 from the diameter of the sleeve 278 at ambient temperature (e.g., ambient temperature of the installation environment, etc.) to a smaller diameter that is less than the diameter of the packing segment 274 of the plunger bore 216; (2) inserted into position within the packing segment 274; and (3) heated (e.g., actively using any source of heat and/or heating device, passively by allowing the sleeve 278 to naturally return to ambient temperature via exposure to ambient temperature, etc.) to increase the diameter of the sleeve 278 from the reduced diameter to a diameter that is approximately equal to or slightly greater than the diameter of the packing segment 274 (e.g., return the sleeve 278 to the diameter of the sleeve 278 at ambient temperature, etc.). As used herein, heating an object (e.g., the sleeve 278, a retention mechanism, etc.) to return an object toward or to the size of the object at ambient temperature selectively includes one or both of the following: (1) passively allowing the object to return to ambient temperature via exposure to ambient temperature; and (2) actively heating the object using any source of heat and/or heating device.

In yet another example of installing the sleeve 278 into the packing segment 274 of the plunger bore 216, the body 290 of the sleeve 278 is configured to be snap-fit into the packing segment 274. For example, in some embodiments the body 290 of the sleeve 278 is resilient and has a ring shape that is open (as opposed to the closed ring shape of the body 290 shown herein) such that the body 290 is: (1) partially collapsed radially inward relative to the central longitudinal axis 292 against a bias of the body 290 to the natural resting size and shape of the body 292 (e.g., using a tool, an individual's hand(s), etc.); (2) inserted into position within the packing segment 274; and (3) expanded radially outward back to the natural resting size and shape of the body 292 by the resilience of the body 292 (i.e., the bias of the body 292 to the natural resting size and shape) to thereby form an interference-fit with the packing segment 274.

As shown in FIG. 3, the seal 286 is operatively connected between the outer wall 288 of the sleeve 278 and the inner wall 272 of the packing segment 274 to facilitate sealing the sleeve 278 to the plunger bore 216. Specifically, the body 312 of the o-ring 310 of the seal 286 is shown in FIG. 3 as being compressed between the inner and outer walls 272 and 288, respectively, of the respective packing segment 274 and sleeve 278 such that the o-ring 310 seals the interface between the inner wall 272 and the outer wall 288. In other embodiments, the o-ring 310 forms a seal at the interface between the inner wall 272 and the outer wall 288 without being compressed or being compressed a lesser or greater amount than is shown in FIG. 3. In the exemplary embodiment of the seal 286, the body 312 of the o-ring 310 is received within a groove 320 that extends into the inner wall 272 of packing segment 274. In other embodiments, the groove 320 additionally or alternatively is formed within the outer wall 288 of the sleeve 278. In still other embodiments, the groove 320 is not included within either of the inner wall 272 or the outer wall 288.

Although the seal 286 can be positioned at any location along the length (i.e., along the central longitudinal axis 292) of the sleeve 278, in the exemplary embodiment shown herein the seal 286 is positioned along the central longitudinal axis 292 of the sleeve 278 closer to the end portion 294 of the sleeve 278 than to the end portion 296 of the sleeve 278. Positioning the seal 286 closer to the end portion 294 positions the seal 286 closer to the pressure chamber 318 of the fluid cylinder 208, which for example may reduce the forces applied to the seal 286 during operation of the reciprocating pump assembly 100. Reducing the forces applied to the seal 286 during operation of the reciprocating pump assembly 100 increases the longevity of the seal 286 and thereby reduces operating costs of the reciprocating pump assembly 100.

As shown in FIG. 3, the retention mechanism 284 secured within the plunger bore 216 such that the retention mechanism 284 is configured to retain the sleeve 278 within the packing segment 274 of the plunger bore 216 during operation of the reciprocating pump assembly 100. For example, in the exemplary embodiment shown in FIG. 3, the plunger bore 216 includes a groove 322 extending into the inner wall 272 and the body 300 of the retention mechanism 284 extends within the groove 322. Specifically, the natural resting size of the resilient snap ring defined by the body 300 of the exemplary retention mechanism 284 is larger than the diameter of the plunger bore 216 on either side of the groove 322 such that the body 300 of the retention mechanism 284 is captured (i.e., held) between opposing sidewalls 324 and 326 of the groove 322. The sidewalls 324 and 326 of the groove 322 thus retain the body 300 of the retention mechanism 284 within the groove 322 such that the retention mechanism 284 is secured in position within the plunger bore 216.

In some embodiments, the body 300 of the retention mechanism 284 forms an interference-fit with a bottom wall 328 and/or with the sidewalls 324 and/or 326 of the groove 322 to further facilitate retaining the body 300 within the groove 322. Optionally, the groove 322 (e.g., the sidewall 324, the sidewall 326, the bottom wall 328, etc.) and/or the body 300 of the retention mechanism 284 includes one or more barbs, textured areas (e.g., raised surfaces, patterned surfaces, etc.), protrusions, and/or the like that facilitates providing the interference-fit between the body 300 and the groove 322. In addition or alternatively to merely being captured between the sidewalls 324 and 326 or both being captured between the sidewalls 324 and 326 and having an interference-fit with the groove 322, in some embodiments the body 300 of the retention mechanism 284 is secured within the groove 322 using one or more welds, an epoxy, an adhesive (e.g., ethanol-based adhesives, water-based adhesives, glues, cements, etc.) or other type of bonding agent, one or more threaded fasteners (e.g., bolts, screws, nuts, studs, etc.), one or more other types of fasteners (e.g., clips, clamps, dowels, pins, rods, latches, etc.), and/or the like. In one specific example, a port (not shown) is formed (e.g., drilled, etc.) through the fluid cylinder 208 that intersects the groove 322 and a pin, dowel, rod, and/or the like (not shown) is inserted into the groove 322 through the port to engage the body 300 of the retention mechanism 284 and thereby facilitate holding the body 300 within the groove 322.

In some other embodiments, the plunger bore 216 does not include the groove 322 and the body 300 of the retention mechanism 284 is secured in position within the plunger bore 216 (e.g., secured directly to the inner wall 272 of the plunger bore 216, etc.) using any manner, device, structure, mechanism, substance, and/or the like that enables the retention mechanism 284 to function as described and/or illustrated herein, such as, but not limited to, using an interference-fit (optionally using one or more barbs, textured areas, protrusions, and/or the like), a press-fit, a snap-fit, one or more welds, an epoxy, an adhesive (e.g., ethanol-based adhesives, water-based adhesives, glues, cements, etc.) or other type of bonding agent, one or more threaded fasteners (e.g., bolts, screws, nuts, studs, etc.), one or more other types of fasteners (e.g., clips, clamps, dowels, pins, rods, latches, etc.), and/or the like.

As described above, the exemplary embodiment of the retention mechanism 284 is a snap ring that can be installed within the groove 322 (or directly to the inner wall 272 of the plunger bore 216 if no groove 322 is provided) by being snap-fit within the groove 322. For example, the body 300 of the retention mechanism 284 can be: (1) partially collapsed radially inward against a bias of the body 300 to the natural resting size and shape of the body 300 (e.g., using a tool, an individual's hand(s), etc.); (2) inserted into position within the plunger bore 216; and (3) expanded radially outward back to or toward the natural resting size and shape of the body 300 by the resilience of the body 300 (i.e., the bias of the body 300 to the natural resting size and shape) such that the body 300 extends into the groove 322.

In the exemplary embodiment of the retention mechanism 284, the body 300 of the retention mechanism 284 abuts (i.e., engages in physical contact with) the end portion 296 of the sleeve 278 when installed in position within the plunger bore 216 (e.g., within the groove 322 as shown in FIG. 3 and described above, etc.). Specifically, the body 300 of the retention mechanism 284 abuts an end surface 330 of the end portion 296 of the sleeve 278. In some embodiments, the inner diameter of the body 300 of the retention mechanism 284 is smaller than the inner diameter of the sleeve 278 at the end surface 330 to increase the surface area of the engagement between the body 300 and the end surface 330 of the sleeve 278, as is shown in FIG. 3. In other embodiments, the inner diameter of the body 300 of the retention mechanism 284 is larger than the inner diameter of the sleeve 278 at the end surface 330.

The engagement between the body 300 of the retention mechanism 284 and the end surface 330 of the sleeve 278 prevents the sleeve 278 from moving within the packing segment 274 of the plunger bore 216 in the direction of the arrow 332 (e.g., prevents the sleeve 278 from backing out of the packing segment 274 of the plunger bore 216, etc.). Thus, the engagement between the body 300 of the retention mechanism 284 and the end surface 330 of the sleeve 278, as well as the engagement between the end portion 294 of the sleeve 278 and the ledge 316 of the plunger bore 216 described above, fixedly secures the sleeve 278 in position within the plunger bore 216 (e.g., in the position shown in FIG. 3). The retention mechanism 284 thereby retains the sleeve 278 within the packing segment 274 of the plunger bore 216 during operation of the reciprocating pump assembly 100. For example, the retention mechanism 284 shown in FIG. 3 is configured to retain the sleeve 278 within the packing segment 274 of the plunger bore 216 under relatively high cyclical rates, relatively high pressures, relatively high loads, and/or relatively low operational temperatures of the reciprocating pump assembly 100 (e.g., pressures of at least approximately 5,000 pounds per square inch (psi), pressures of at least approximately 10,000 psi, pressures between approximately 8,000 psi and approximately 26,000 psi, pressures greater than approximately 15,000 psi, rates of up to approximately 1,000 strokes per minute, rates of greater than approximately 1,000 strokes per minute, temperatures below approximately 0° C., temperatures below approximately −20° C., temperatures between approximately 0° C. and approximately −40° C., temperatures below approximately −40° C., etc.).

In some other embodiments, the body 300 of the retention mechanism 284 does not abut the end portion 296 of the sleeve 278 when installed in position within the plunger bore 216 (i.e., as installed the body 300 is spaced apart from the end surface 330 of the end portion 296 of the sleeve 278). In such other embodiments, the retention mechanism 284 provides a secondary retention mechanism that retains the sleeve 278 within the packing segment 274 of the plunger bore 216 upon failure of a primary retention mechanism (e.g., the interference-fit, weld(s), epoxy, adhesive or other type of bonding agent, threaded fastener(s), other type(s) of fastener(s), and/or the like described above that secure the sleeve 278 within the packing segment 274 of the plunger bore 216, etc.). In operation as a secondary retention mechanism, upon failure of the primary retention mechanism, any movement of the sleeve 278 within the packing segment 274 in the direction of the arrow 332 will bring the end surface 330 of the end portion 296 of the sleeve 278 into abutment (i.e., into engagement in physical contact) with the body 300 of the retention mechanism 284. The engagement between the body 300 of the retention mechanism 284 and the end surface 330 of the sleeve 278 prevents any further movement of the sleeve 278 within the packing segment 274 in the direction of the arrow 332. The retention mechanism 284 thereby retains the sleeve 278 within the packing segment 274 of the plunger bore 216 upon failure of the primary retention mechanism during operation of the reciprocating pump assembly 100 (e.g., prevents the sleeve 278 from backing out of the packing segment 274 of the plunger bore 216, etc.)

As described above, the retention mechanism 284 is not limited to a snap-ring or any other type of ring. Rather, the retention mechanism 284 additionally or alternatively can include any other structure that enables the retention mechanism 284 to function as described and/or illustrated herein. For example, in some other embodiments, the body 300 of the retention mechanism 284 has a ring shaped that is closed or has an open ring shape but is not a resilient snap ring. In one specific alternative example, the body 300 of the retention mechanism 284 is a multi-piece ring having individual segments that are snapped, interlocked, bonded, and/or otherwise assembled together to define an open or closed ring structure.

In embodiments wherein the body 300 of the retention mechanism 284 is a ring but not a snap-ring (whether the body 300 is an open or closed ring), the body 300 can be secured within the plunger bore 216 using any manner, device, structure, mechanism, substance, and/or the like that enables the retention mechanism 284 to function as described and/or illustrated herein, such as, but not limited to, an interference-fit (optionally using one or more barbs, textured areas, protrusions, and/or the like; e.g., by being shrunken radially inward and thereafter inserted into the plunger bore 216 such that the body 300 forms an interference-fit as the body 300 expands radially outward, as is described herein with reference to the sleeve 278, etc.), a press-fit, one or more welds, an epoxy, an adhesive (e.g., ethanol-based adhesives, water-based adhesives, glues, cements, etc.) or other type of bonding agent, one or more threaded fasteners (e.g., bolts, screws, nuts, studs, etc.), one or more other types of fasteners (e.g., clips, clamps, dowels, pins, rods, latches, etc.), being captured within a groove, being secured directly to the inner wall 272 of the plunger bore 216, and/or the like.

Figure 10:
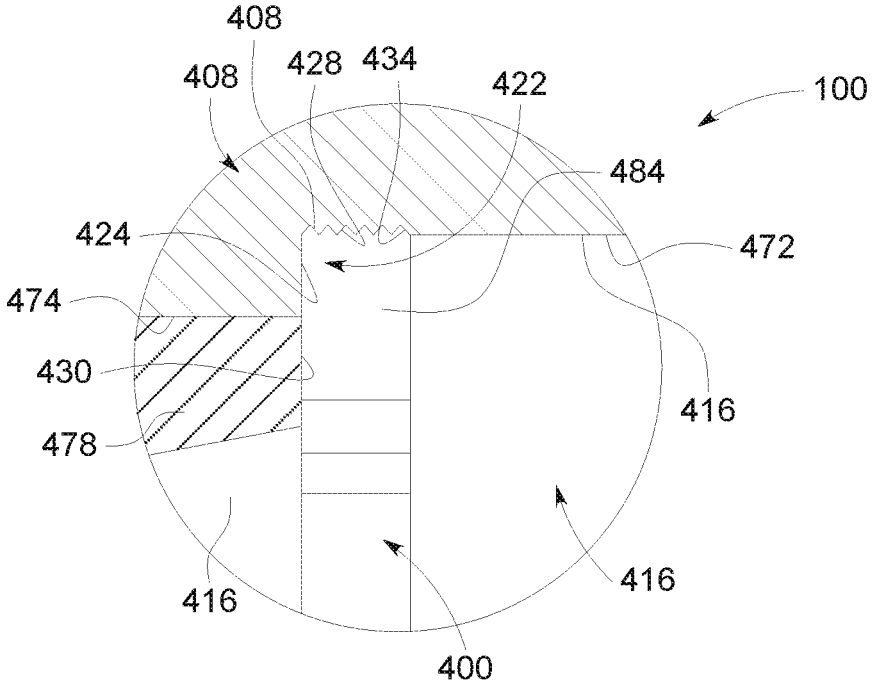
FIG. 10 is a cross-sectional view illustrating a retention mechanism according to another exemplary embodiment.

Referring now to FIG. 10, another exemplary embodiment of a retention mechanism 484 is shown. In the embodiment of FIG. 10, a plunger bore 416 of a fluid cylinder 408 of the reciprocating pump assembly 100 (FIG. 1) includes a recess 422 instead of the groove 322 (FIG. 3). The recess 422 is a cutout that extends into an inner wall 472 of the plunger bore 416 and includes a ledge 424 and a side wall 428. As shown in FIG. 10, the side wall 428 of the recess 422 includes a thread 434. The retention mechanism 484 is a threaded insert that is configured to be received within the recess 422. Specifically, the retention mechanism 484 includes a body 400 having an open or closed ring shape and a thread 436. When installed within the recess 422 as shown in FIG. 10, the threads 434 and 436 are interlocked such that the body 400 of the retention mechanism 484 is threadedly received within the recess 422. As illustrated in FIG. 10, the body 400 of the retention mechanism 484 abuts an end surface 430 of a sleeve 478 such that the retention mechanism 484 is configured to retain the sleeve 478 within a packing segment 474 of the plunger bore 416 during operation of the reciprocating pump assembly 100.

In addition to being threadedly received within the recess 422, the retention mechanism 484 optionally is secured within the recess 422 using a press-fit, an interference-fit, a snap-fit, one or more welds, an epoxy, an adhesive (e.g., ethanol-based adhesives, water-based adhesives, glues, cements, etc.) or other type of bonding agent, and/or the like. Moreover, although shown as providing a primary retention mechanism, in other embodiments the retention mechanism 484 provides a secondary retention mechanism (e.g., as is described above with respect to the retention mechanism 284 shown in FIGS. 3, 6, and 7, etc.)

Figure 11:
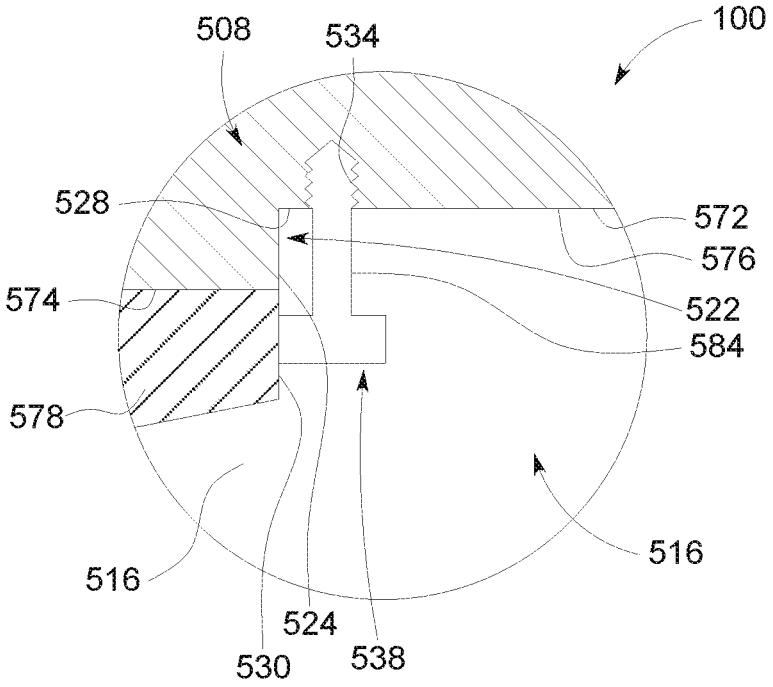
FIG. 11 is a cross-sectional view illustrating a retention mechanism according to yet another exemplary embodiment.

Referring now to FIG. 11, another exemplary embodiment of a retention mechanism 584 is shown. In the embodiment of FIG. 11, a plunger bore 516 of a fluid cylinder 508 of the reciprocating pump assembly 100 (FIG. 1) includes a recess 522 instead of the groove 322 (FIG. 3). The recess 522 is a cutout that extends into an inner wall 572 of the plunger bore 516 and includes a ledge 524 and a side wall 528. As shown in FIG. 11, the side wall 528 of the recess 522 includes a threaded opening 534. The retention mechanism 584 is a threaded fastener that is configured to be threadedly received within the threaded opening 534. When threadedly received within the threaded opening 534, the retention mechanism 584 extends within the recess 522 such that a head 538 of the retention mechanism 584 abuts an end surface 530 of a sleeve 578 such that the retention mechanism 584 is configured to retain the sleeve 578 within a packing segment 574 of the plunger bore 516 during operation of the reciprocating pump assembly 100. In addition to being threadedly connected to the opening 534, the retention mechanism 584 optionally is secured within the opening 534 using a press-fit, an interference-fit, a snap-fit, one or more welds, an epoxy, an adhesive (e.g., ethanol-based adhesives, water-based adhesives, glues, cements, etc.) or other type of bonding agent, and/or the like.

Although only one is shown (i.e., visible) herein, the fluid cylinder 508 may include any number of the retention mechanisms 584 positioned around the circumference of the sleeve 578. Moreover, the retention mechanism 584 is not limited to threaded fasteners. Rather, in other embodiments the retention mechanism 584 additionally or alternatively includes one or more other types of fasteners (e.g., a clip, a clamp, a dowel, a pin, a rod, a latch, etc.), which may be secured within the opening 534 using any manner, device, structure, mechanism, substance, and/or the like that enables the retention mechanism 584 to function as described and/or illustrated herein, such as, but not limited to, using a press-fit, an interference-fit, a snap-fit, one or more welds, an epoxy, an adhesive (e.g., ethanol-based adhesives, water-based adhesives, glues, cements, etc.) or other type of bonding agent, and/or the like.

It should be understood that the embodiment of the retention mechanism 584 is not limited to being used with the recess 522, but rather the opening 534 may be provided within a groove (e.g., the groove 322 shown in FIG. 3, etc.) extending within the inner wall 572 of the plunger bore 516. In some other embodiments, the plunger bore 516 does not include the recess 522 or a groove and instead the opening 534 is provided directly into the inner wall 572 of the plunger bore 516.

Although shown as providing a primary retention mechanism, in other embodiments the retention mechanism 584 provides a secondary retention mechanism (e.g., as is described above with respect to the retention mechanism 284 shown in FIGS. 3, 6, and 7, etc.)

Figure 12:
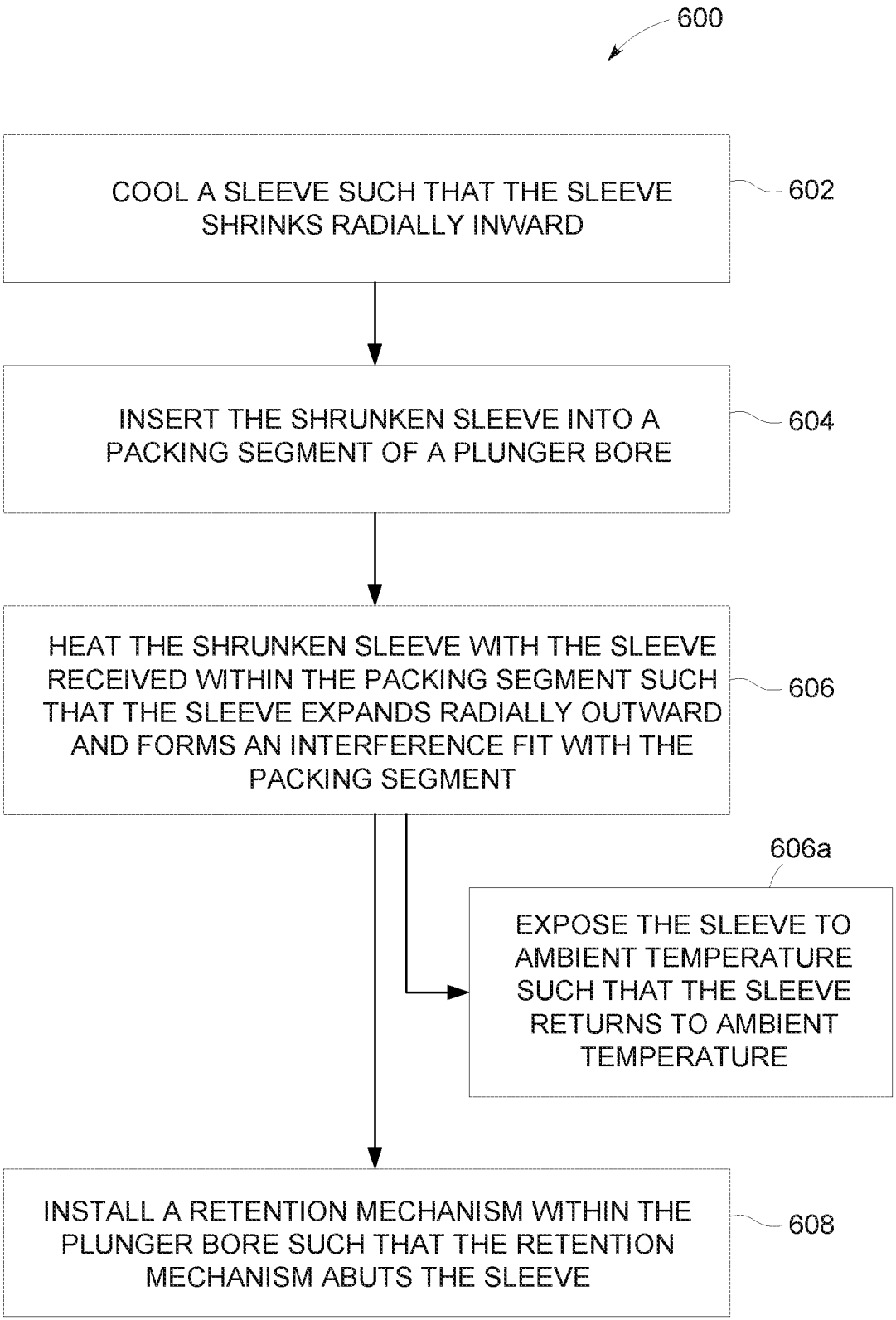
FIG. 12 is a flowchart illustrating a method for installing a sleeve within a plunger bore of a fluid end section of a reciprocating pump according to an exemplary embodiment.

FIG. 12 is a flowchart illustrating a method 600 for installing a sleeve within a plunger bore of a fluid end section of a reciprocating pump according to an exemplary embodiment. The method 600 includes cooling, at 602, the sleeve such that the sleeve shrinks radially inward. At 604, the method 600 includes inserting the shrunken sleeve into a packing segment of the plunger bore. At 606, the method 600 includes heating the shrunken sleeve with the sleeve received within the packing segment such that the sleeve expands radially outward and forms an interference fit with the packing segment. In some embodiments, heating at 606 the shrunken sleeve includes exposing, at 606*a*, the sleeve to ambient temperature (e.g., ambient temperature of the installation environment, etc.) such that the sleeve returns to ambient temperature.

At 608, the method 600 includes installing a retention mechanism within the plunger bore such that the retention mechanism abuts the sleeve.

The retention mechanism embodiments disclosed herein provide improved retention of a sleeve within the plunger bore of a reciprocating pump. The retention mechanism embodiments disclosed herein thus increase the longevity of the sleeve and thereby reduce operating costs of the reciprocating pump. The sleeve and retention mechanism embodiments disclosed herein provide relatively inexpensive and reliable solutions for remedying washboarding and/or washout of the packing segment of the plunger bore of a reciprocating pump. The sleeve and retention mechanism embodiments disclosed herein thereby increase the longevity of a fluid cylinder of the reciprocating pump and thus reduce operating costs of the reciprocating pump.

The following clauses describe further aspects of the disclosure:

Clause Set A:

A1. A fluid cylinder for a fluid end section of a reciprocating pump, the fluid end cylinder comprising:

a body having a pressure chamber and a plunger bore that fluidly communicates with the pressure chamber, the plunger bore comprising a packing segment configured to hold packing;

a sleeve received within the packing segment of the plunger bore, the sleeve being configured to hold a plunger within an internal passage of the sleeve such that the plunger is configured to reciprocate within the plunger bore during operation of the reciprocating pump; and a retention mechanism secured within the plunger bore such that the retention mechanism is configured to retain the sleeve within the packing segment of the plunger bore.

A2. The fluid cylinder of clause A1, wherein the retention mechanism comprises a snap ring.

A3. The fluid cylinder of clause A1, wherein the retention mechanism abuts an end portion of the sleeve.

A4. The fluid cylinder of clause A1, wherein the sleeve is fixedly secured within the packing segment of the plunger bore at least in part by the retaining mechanism.

A5. The fluid cylinder of clause A1, further comprising a seal operatively connected between the sleeve and the packing segment of the plunger bore.

A6. The fluid cylinder of clause A1, wherein the retention mechanism comprises a ring having an inner diameter that is smaller than an inner diameter of the sleeve.

A7. The fluid cylinder of clause A1, wherein the plunger bore comprises a groove extending into an inner wall of the plunger bore, the retention mechanism extending within the groove.

A8. The fluid cylinder of clause A1, wherein the plunger bore comprises a recess extending into an inner wall of the plunger bore, the retention mechanism extending within the recess.

A9. The fluid cylinder of clause A1, wherein the plunger bore comprises a recess extending into an inner wall of the plunger bore, the recess comprising a thread, the retention mechanism comprising a threaded insert that is threadedly received within the recess.

A10. The fluid cylinder of clause A1, wherein the retention mechanism is secured within the plunger bore using at least one of an interference-fit, a press-fit, a snap-fit, a weld, an epoxy, an adhesive, a fastener, or a threaded fastener.

Clause Set B:

B1. A reciprocating pump comprising:

a power end section; and a fluid end section operatively connected to the power end section, the fluid end section having a fluid cylinder comprising:

- a body having a pressure chamber and a plunger bore that fluidly communicates with the pressure chamber, the plunger bore comprising a packing segment configured to hold packing;
- a sleeve received within the packing segment of the plunger bore, the sleeve being configured to hold a plunger within an internal passage of the sleeve such that the plunger is configured to reciprocate within the plunger bore during operation of the reciprocating pump; and
- a retention mechanism secured within the plunger bore such that the retention mechanism is configured to retain the sleeve within the packing segment of the plunger bore.

B2. The reciprocating pump of clause B1, wherein the retention mechanism comprises a snap ring.

B3. The reciprocating pump of clause B1, wherein the retention mechanism abuts an end portion of the sleeve.

B4. The reciprocating pump of clause B1, wherein the sleeve is fixedly secured within the packing segment of the plunger bore at least in part by the retaining mechanism.

B5. The reciprocating pump of clause B1, wherein the fluid cylinder further comprises a seal operatively connected between the sleeve and the packing segment of the plunger bore.

B6. The reciprocating pump of clause B1, wherein the plunger bore comprises a groove extending into an inner wall of the plunger bore, the retention mechanism extending within the groove.

B7. The reciprocating pump of clause B1, wherein the plunger bore comprises a recess extending into an inner wall of the plunger bore, the retention mechanism extending within the recess.

B8. The reciprocating pump of clause B1, wherein the retention mechanism is secured within the plunger bore using at least one of an interference-fit, a press-fit, a snap-fit, a weld, an epoxy, an adhesive, a fastener, or a threaded fastener.

Clause Set C:

C1. A method for installing a sleeve within a plunger bore of a fluid end section of a reciprocating pump, the method comprising:

cooling the sleeve such that the sleeve shrinks radially inward;

inserting the shrunken sleeve into a packing segment of the plunger bore;

heating the shrunken sleeve with the sleeve received within the packing segment such that the sleeve expands radially outward and forms an interference fit with the packing segment; and installing a retention mechanism within the plunger bore such that the retention mechanism abuts the sleeve.

C2. The method of clause C1, wherein heating the shrunken sleeve comprises exposing the sleeve to ambient temperature such that the sleeve returns to ambient temperature.

It is to be understood that the above description is intended to be illustrative, and not restrictive. For example, the above-described embodiments (and/or aspects thereof) may be used in combination with each other. Furthermore, invention(s) have been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention(s). Further, each independent feature or component of any given assembly may constitute an additional embodiment. In addition, many modifications may be made to adapt a particular situation or material to the teachings of the disclosure without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the disclosure should, therefore, be determined with reference to the appended claims, along with the full scope of equivalents to which such claims are entitled.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "clockwise" and "counterclockwise", "left" and right", "front" and "rear", "above" and "below" and the like are used as words of convenience to provide reference points and are not to be construed as limiting terms.

When introducing elements of aspects of the disclosure or the examples thereof, the articles "a," "an," "the," and "said" are intended to mean that there are one or more of the elements. The terms "comprising," "including," and "having" are intended to be inclusive and mean that there may be additional elements other than the listed elements. For example, in this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised", "comprises", "having", "has", "includes", and "including" where they appear. Further, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property can include additional elements not having that property. The term "exemplary" is intended to mean "an example of." The phrase "one or more of the following: A, B, and C" means "at least one of A and/or at least one of B and/or at least one of C." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

Although the terms "step" and/or "block" may be used herein to connote different elements of methods employed, the terms should not be interpreted as implying any particular order among or between various steps herein disclosed unless and except when the order of individual steps is explicitly described. The order of execution or performance of the operations in examples of the disclosure illustrated and described herein is not essential, unless otherwise specified. The operations may be performed in any order, unless otherwise specified, and examples of the disclosure may include additional or fewer operations than those disclosed herein. It is therefore contemplated that executing or performing a particular operation before, contemporaneously with, or after another operation is within the scope of aspects of the disclosure.

Having described aspects of the disclosure in detail, it will be apparent that modifications and variations are possible without departing from the scope of aspects of the disclosure as defined in the appended claims. As various changes could be made in the above constructions, products, and methods without departing from the scope of aspects of the disclosure, it is intended that all matter contained in the above description and shown in the accompanying drawings shall be interpreted as illustrative and not in a limiting sense.

What is claimed is:

1. A fluid cylinder for a fluid end section of a reciprocating pump, the fluid cylinder comprising:

a body having a pressure chamber and a plunger bore that fluidly communicates with the pressure chamber, the plunger bore comprising a packing segment configured to hold packing, wherein the plunger bore includes a groove in an inner wall of the body;

a sleeve received within the packing segment of the plunger bore, the sleeve including an inner wall that defines an internal passage that is configured to hold a plunger, wherein the plunger is configured to reciprocate within the internal passage of the sleeve during operation of the reciprocating pump; and a snap ring, wherein a body of the snap ring is separate from the sleeve, wherein the body of the snap ring is at least partly disposed in the groove and at least partly extending radially inward into the plunger bore, wherein the body of the snap ring abuts an outermost longitudinal end of the sleeve that faces away from the pressure chamber to retain the sleeve within the packing segment of the plunger bore, and wherein contact between the body of the snap ring and the outermost longitudinal end of the sleeve extends from an outer wall of the sleeve that contacts the inner wall of the body to the inner wall of the sleeve, wherein an inner diameter of the body of the snap ring is smaller than a minimum inner diameter of the sleeve at the outermost longitudinal end.

2. The fluid cylinder of claim 1, further comprising a seal operatively connected between the sleeve and the packing segment of the plunger bore, wherein the seal is radially contacting the outer wall of the sleeve and the inner wall of the body of the fluid cylinder, wherein the seal is positioned relatively closer to a first end of the sleeve, nearest the pressure chamber, than a second end of the sleeve, opposite the first end.

3. The fluid cylinder of claim 1, wherein the snap ring is secured within the plunger bore using at least one of an interference-fit, a press-fit, a snap-fit, a weld, an epoxy, an adhesive, a fastener, or a threaded fastener.

4. The fluid cylinder of claim 1, wherein the outermost longitudinal end of the sleeve is tapered.

5. A fluid cylinder for a fluid end section of a reciprocating pump, comprising:

a body having a pressure chamber and a plunger bore that fluidly communicates with the pressure chamber, the plunger bore comprising a packing segment configured to hold packing, wherein the plunger bore includes a groove in an inner wall of the body;

a sleeve received within the packing segment of the plunger bore, the sleeve being configured to hold a plunger within an internal passage of the sleeve such that the plunger is configured to reciprocate within the plunger bore during operation of the reciprocating pump;

a seal between an outer wall of the sleeve and the inner wall of the body, wherein the seal is positioned relatively closer to an innermost longitudinal end of the sleeve, that faces the pressure chamber, than an outermost longitudinal end of the sleeve, that faces away from the pressure chamber; and a snap ring secured within the plunger bore such that the snap ring is configured to retain the sleeve within the packing segment of the plunger bore, wherein the snap ring includes a body having a ring shape, wherein the body of the snap ring is separate from the sleeve and abuts the outermost longitudinal end of the sleeve that faces away from the pressure chamber, wherein an inner diameter of the body of the snap ring is smaller than a minimum inner diameter of the sleeve at the outermost longitudinal end, and wherein the body of the snap ring is at least partly disposed in the groove and at least partly extending radially inward into the plunger bore.

6. The fluid cylinder of claim 5, wherein the sleeve is fixedly secured within the packing segment of the plunger bore at least in part by the snap ring.

7. The fluid cylinder of claim 5, wherein the seal is radially contacting the outer wall of the sleeve and the inner wall of the body of the fluid cylinder.

8. The fluid cylinder of claim 5, wherein the snap ring is secured within the plunger bore using at least one of an interference-fit, a press-fit, a snap-fit, a weld, an epoxy, an adhesive, a fastener, or a threaded fastener.

9. The fluid cylinder of claim 5, wherein an inner diameter of the body of the snap ring is smaller than a minimum inner diameter of the sleeve at the outermost longitudinal end.

10. The fluid cylinder of claim 9, wherein the outermost longitudinal end of the sleeve is tapered.

11. The fluid cylinder of claim 5, further comprising a seal groove in the inner wall of the body, wherein at least a portion of the seal is in the seal groove.

12. The fluid cylinder of claim 11, wherein the seal includes an o-ring and a backing that supports the o-ring.

13. The fluid cylinder of claim 5, further comprising a seal groove in the outer wall of the sleeve, wherein at least a portion of the seal is in the seal groove.

14. The fluid cylinder of claim 5, wherein the seal is spaced from the innermost longitudinal end of the sleeve.

15. The fluid cylinder of claim 5, wherein the plunger bore includes a ledge that faces away from the pressure chamber, and wherein the innermost longitudinal end of the sleeve abuts the ledge.

16. The fluid cylinder of claim 15, wherein a total length of the sleeve matches a distance from the ledge to the groove.

17. A method for installing a sleeve within a plunger bore of a fluid end section of a reciprocating pump, the method comprising:

cooling the sleeve such that the sleeve shrinks radially inward;

inserting, in a first direction, the shrunken sleeve into a packing segment of the plunger bore;

heating the shrunken sleeve with the sleeve received within the packing segment such that the sleeve expands radially outward and forms an interference fit with the packing segment, the sleeve including an inner wall that defines an internal passage that is configured to hold a plunger; and installing, in the first direction, a retention mechanism within the plunger bore such that the retention mechanism abuts the sleeve, wherein the retention mechanism includes a body having a ring shape, wherein the body of the retention mechanism abuts an outermost longitudinal end of the sleeve facing away from the first direction, wherein the plunger bore includes a groove in an inner wall of the body, wherein the body of the retention mechanism is at least partly disposed in the groove and at least partly extending radially inward into the plunger bore, and wherein contact between the body of the retention mechanism and the outermost longitudinal end of the sleeve extends from an outer wall of the sleeve that contacts the inner wall of the body to the inner wall of the sleeve, wherein an inner diameter of the body of the snap ring is smaller than a minimum inner diameter of the sleeve at the outermost longitudinal end.

18. The method of claim 17, wherein heating the shrunken sleeve comprises exposing the sleeve to ambient temperature such that the sleeve returns to ambient temperature.

19. The method of claim 17, wherein the retention mechanism is installed within the plunger bore after the sleeve is inserted.

20. The method of claim 17, wherein the retention mechanism comprises a snap ring.

* * * * *